US011192746B2

(12) United States Patent
Deng et al.

(10) Patent No.: US 11,192,746 B2
(45) Date of Patent: Dec. 7, 2021

(54) CUTTER BLADE DUAL SIDE FILM SEALING AND PACKING ASSEMBLY

(71) Applicant: DONGGUAN UNIVERSITY OF TECHNOLOGY, Dongguan (CN)

(72) Inventors: Jun Deng, Dongguan (CN); Jianyu Long, Dongguan (CN); Yun Bai, Dongguan (CN); Bo Zeng, Dongguan (CN)

(73) Assignee: DONGGUAN UNIVERSITY OF TECHNOLOGY, Dongguan (CN)

( * ) Notice: Subject to any disclaimer, the term of this patent is extended or adjusted under 35 U.S.C. 154(b) by 197 days.

(21) Appl. No.: 16/416,183

(22) Filed: May 18, 2019

(65) Prior Publication Data

US 2019/0359442 A1 Nov. 28, 2019

(30) Foreign Application Priority Data

May 23, 2018 (CN) ..... 201810501628.8

(51) Int. Cl.
*B65H 35/00* (2006.01)
*B26D 1/04* (2006.01)
(Continued)

(52) U.S. Cl.
CPC ..... *B65H 35/0086* (2013.01); *B26D 1/045* (2013.01); *B65B 9/02* (2013.01);
(Continued)

(58) Field of Classification Search
CPC ..... B65B 9/02; B65B 25/003; B65B 35/24; B65B 41/16; B65B 51/26; B65B 57/00; B65B 57/10; B65B 65/003
(Continued)

(56) References Cited

U.S. PATENT DOCUMENTS 3,513,620 A * 5/1970 Billingsley ..... B65B 9/06 53/398
3,636,678 A * 1/1972 Maros ..... B65B 9/02 53/412

(Continued)

*Primary Examiner* — Hemant Desai
*Assistant Examiner* — Jacob A Smith

(57) ABSTRACT

The present invention relates to an automatic package device, which may include a rack and a power control box provided on the rack. The cutter blade transportation device is provided on the rack along the X axis direction. Below the cutter blade transportation device and inside the rack, lower film feeding device is provided. At the rear side of the rack, the upper film feeding device is provided. At the front end of the cutter blade transportation device and on the rack are provided a blade feeding rail and cutter blade carrying device cooperating with each other. At the rear end of the cutter blade transportation device is provided a film sealing device which cooperates with the upper film feeding device and lower film feeding device. At the rear end of the film sealing device and on the rack is provided a dragging device fitting the blade strip. At the back side of the dragging device is provided a transverse cutting device fitting the blade strip. The present invention may achieve automatic feeding by the cutter blade carrying device. The dragging device may extend the upper and lower film material back and forth repeatedly. And the hot-pressing process may be accomplished by the film sealing device. The present invention may automatically seal the blades and the cutting device may separate the product one by one. At last the packaging process may be accomplished with high degree of automation and greatly improve production efficiency.

10 Claims, 9 Drawing Sheets

(51) Int. Cl.

| | |
|---|---|
| ***B65B 41/16*** | (2006.01) |
| ***B65B 61/06*** | (2006.01) |
| ***B65H 35/06*** | (2006.01) |
| ***B65B 35/44*** | (2006.01) |
| ***B65B 35/56*** | (2006.01) |
| ***B65B 57/10*** | (2006.01) |
| ***B65B 25/00*** | (2006.01) |
| ***B65B 9/02*** | (2006.01) |
| ***B65B 51/26*** | (2006.01) |
| *B31B 70/81* | (2017.01) |
| *B65B 51/14* | (2006.01) |

(52) U.S. Cl.
CPC ..... *B65B 25/003* (2013.01); *B65B 35/44* (2013.01); *B65B 35/56* (2013.01); *B65B 41/16* (2013.01); *B65B 51/26* (2013.01); *B65B 57/10* (2013.01); *B65B 61/06* (2013.01); *B65H 35/06* (2013.01); *B31B 70/8132* (2017.08); *B65B 51/14* (2013.01)

(58) Field of Classification Search
USPC ..... 53/553, 555, 53
See application file for complete search history.

(56) References Cited

U.S. PATENT DOCUMENTS 3,807,117 A * 4/1974 Abrams ..... B65B 21/245 53/398
3,928,941 A * 12/1975 Singer ..... B65B 51/30 53/553
4,008,554 A * 2/1977 Hardy ..... B65B 9/04 53/453
4,027,047 A * 5/1977 Harima ..... A23G 1/22 426/383
4,244,158 A * 1/1981 Nelham ..... B26D 1/04 53/412
4,307,555 A * 12/1981 Mlodozeniec ..... A61J 3/00 53/53
4,377,061 A * 3/1983 Olson ..... B65B 9/02 53/433
4,466,228 A * 8/1984 Gess ..... B65B 9/02 156/515
4,596,111 A * 6/1986 Ambrose ..... B65B 23/00 53/170
4,774,800 A * 10/1988 D'Angelo ..... B65B 51/26 425/520
4,870,802 A * 10/1989 Cerf ..... B65B 9/02 53/442
4,974,824 A * 12/1990 Kimbel ..... B65B 9/02 270/58.05
5,001,888 A * 3/1991 Groth ..... B65B 9/02 53/450
5,069,016 A * 12/1991 Grossi ..... B65B 9/026 53/398
5,165,331 A * 11/1992 Hayashi ..... G07F 17/0078 99/450.2
5,269,122 A * 12/1993 Reichental ..... B65B 9/02 53/371.4
5,299,410 A * 4/1994 Freeman ..... B65B 59/003 53/442
5,740,661 A * 4/1998 Yamaguchi ..... B65B 9/02 53/553
5,806,284 A * 9/1998 Gifford ..... B26D 11/00 53/202
5,934,186 A * 8/1999 Alberga ..... A21C 9/08 99/489
6,178,723 B1 * 1/2001 Mossbeck ..... B65B 9/02 53/450
6,467,621 B1 * 10/2002 Ishida ..... A61K 9/703 206/460
9,920,623 B1 * 3/2018 Leeper ..... B65B 51/225
2001/0011445 A1 * 8/2001 Scolaro ..... B65B 31/021 53/433
2003/0208988 A1 * 11/2003 Buckley ..... B65B 61/02 53/411
2004/0093836 A1 * 5/2004 Ouellette ..... B65B 9/02 53/553
2005/0102972 A1 * 5/2005 Frabetti ..... B65B 25/005 53/201
2005/0193880 A1 * 9/2005 Chao ..... B26D 1/385 83/349
2008/0096748 A1 * 4/2008 Antonevich ..... B65B 9/02 493/187
2008/0172989 A1 * 7/2008 Deep ..... B65B 9/02 53/451
2012/0031049 A1 * 2/2012 Doll ..... B65B 9/02 53/432
2014/0021012 A1 * 1/2014 Liao ..... B65B 35/16 198/469.1
2016/0114923 A1 * 4/2016 Kiyota ..... G05B 11/01 53/64
2019/0061981 A1 * 2/2019 Richards ..... A22C 7/0076
2019/0071195 A1 * 3/2019 Hyodo ..... B65B 43/26

* cited by examiner

CUTTER BLADE DUAL SIDE FILM SEALING AND PACKING ASSEMBLY

FIELD OF THE INVENTION

The present invention relates generally to an automatic packing assembly, and more particularly to a cutter blade dual side film sealing and packing assembly.

BACKGROUND OF THE INVENTION

In production line of utility cutter blades, after completion of cutter blade fabrication, packing is done manually; and as the cutter blade is sharp, workers have to handle packing carefully, to have the cutter blades characterized and put into the packing boxes, which is low in production efficiency, in addition, the cutter blades will be liable to damping and rusting when packing with bare paper boxes, which affects quality of cutter blades and production cost.

OVERALL OBJECTIVE OF THE INVENTION

The present invention aims to provide a cutter blade dual side film sealing and packing assembly, wherein cutter blades are automatically loaded with the cutter blade transportation device, conveyed repeatedly by dragging the upper and lower sealing film, thermal pressing of the upper and lower sealing film is done by the film sealing device, automatic sealing is achieved, product separation is done with the cutting device, and finally packing uniformly, which is highly automatic and facilitates manufacturing efficiency.

SUMMARY OF THE INVENTION

To realize the objective above, the present invention adopts the following technical solution: a cutter blade dual side film sealing and packing assembly, includes a rack and a power control box provided on the rack, and on the rack, along the X-axis extension direction, a cutter blade transportation device is provided; below the cutter blade transportation device and inside the rack is provided a lower film feeding device, and in the rear side of the rack is provided an upper film feeding device; before the cutter blade transportation device and on the rack are provided a blade feeding rail and a cutter blade carrying device cooperating with each other and after the cutter blade transportation device is provided a film sealing device which cooperates with the upper film feeding device and lower film feeding device; in the rear side of the film sealing device and on the rack is provided a dragging device fitting the blade strip; and at back side of the dragging device is provided a transverse cutting device fitting the blade strip; a blade guiding device and a blade correcting device are successively provided above the cutter blade transportation device between the cutter blade carrying device and the film sealing device; a defective product reclaiming device is provided between the blade correcting device and the film sealing device.

Furthermore, the cutter blade transportation device may include a transportation supporting plate which is provided on the rack along the X-axis direction, along the transportation direction on the transportation supporting plate is provided a conveyer belt; to the left end of the conveyer belt and on the transportation supporting plate is provided an upper film guiding wheel cooperating with the lower film feeding device and to the right end of the conveyer belt and on the transportation supporting plate is provided an upper film guiding wheel cooperating with the upper film feeding device; the conveyer belt is a magnetic conveyor belt.

Furthermore, both of the upper film feeding device and lower film feeding device may include a material feeding support plate provided on the rack; on the material feeding support plate is provided a coil wheel; to the front side of the coil wheel and on the material feeding support plate is provided a guide roller; the lower film strip from the lower film feeding device may pass the guide roller, the lower film guiding wheel and the conveyer belt and go inside the film sealing device; the upper film strip of the upper film feeding device may pass in turn the guide roller, the upper film guiding wheel and go inside the film sealing device working with the lower film material film tape.

Furthermore, the blade guiding device may include a guide rack provided on the rack, on the guide rack and along the transport direction are provided a guiding cylinder and a guiding sliding rail; the output of the guiding cylinder is connected to the air gripper adjusting seat slidably cooperating with the guiding sliding rail; on the air gripper adjusting seat and above the conveyer belt are provided at least three groups of guiding air grippers; the front end of the guiding air gripper is connected to the guiding and clamping plates fitting the blades; the guiding cylinder and the guiding air gripper are electrically connected to the power control box.

Furthermore, the blade correcting device may include a correcting rack provided on the rack; to the upper end of the correcting rack is provided a correcting top plate; on the correcting top plate, a lifting correcting cylinder is provided vertically downward, the output end of the lifting correcting cylinder is connected to the correcting lifting seat and the correcting lifting seat slidingly cooperating with the lifting rail which is provided vertically on the correcting rack, and to the upper end of the correcting lifting seat is provided a guide rod which cooperates with the correcting top plate by plugging and fitting; to both the left and right sides of the correcting lifting seat, correcting cylinders are provided symmetrically; the output ends of both correcting cylinders are horizontally connected to the correcting holding plate sliding seat slidably fitting with the correcting lifting seat; to the front side of the correcting holding plate sliding seat, are vertically provided the correcting clamp grips cooperating with the blades one by one; all of the lifting correcting cylinder and the correcting cylinders are electrically connected to the power control box.

Furthermore, the defective product reclaiming device and the cutter blade carrying device may include the material reclaiming rack provided on the rack; to the material reclaiming rack are horizontally provided an reclaiming horizontal movable cylinder and reclaiming horizontal movable guiding rail; the output end of the reclaiming horizontal movable cylinder is connected to the reclaiming horizontal movable sliding seat slidingly fitting the reclaiming horizontal movable guiding rail; on the reclaiming horizontal movable sliding seat is vertically provided a lifting pressing cylinder; to the output end of the lifting pressing cylinder is connected the material reclaiming lifting seat slidingly fitting the reclaiming horizontal movable sliding seat; on the material reclaiming lifting seat is vertically provided the lifting reclaiming cylinder whose output is connected to the connecting board slidingly cooperating with the material reclaiming lifting seat; to the lower end of the connecting board is provided a pneumatic air gripper respectively fitting the blades; the pneumatic air grippers cooperate with the guiding pressing plate provided on the lower end of the connecting board by plugging and fitting; to the front side of the defective product reclaiming device and above the cutter blade transportation device is provided a defective product detecting device; to the left side of the cutter blade transportation device on the rack is provided a defective product collecting tank; all of the lifting reclaiming cylinder, lifting pressing cylinder, reclaiming horizontal movable cylinder, pneumatic air gripper and defective product detecting device are electrically connected to the power control box.

Furthermore, the film sealing device may include a film-sealing bottom plate provided on the rack; on the top of the film-sealing bottom plate is connected to the film sealing top plate by upright columns; on the film sealing top plate is vertically provided a film sealing cylinder downwardly; the output end of the film sealing cylinder is connected to the upper electric heating plate, and the upper electric heating plate is in the right end of the cutter blade transportation device and works in conjunction with the lower electric heating plate provided on the film-sealing bottom plate; and on the butting side of the upper electric heating plate and the lower electric heating plate is provided corresponding grooves; all of the film sealing cylinder, the upper electric heating plate and the lower electric heating plate are electrically connected to the power control box.

Furthermore, on the film sealing top plate and at the rear side of the film sealing cylinder is provided a film cutting cylinder vertically downward, and the output end of the film cutting cylinder is connected to the cutting assembly fitting the blade strip; the cutting assembly may include the blade cutting seat which is connected to the output of the film cutting cylinder; below the blade cutting seat and on the film-sealing bottom plate is provided a partition supporting plate; on the partition supporting plate is provided a partition board fitting the longitudinal cutting blade, to the bottom of the partition board are provided material slots fitting the blades, and blade slots are provided between each two groups of the material slots and inside the partition board, the blade slot extends on the partition supporting plate and fits the gap of the longitudinal cutting blade provided on the bottom of the blade cutting seat.

Furthermore, the dragging device may include a dragging base and a motor seat which are provided on the transportation supporting plate; on the dragging base are provided a dragging guide rod and a dragging threaded rod along the transportation direction; the front end, of the dragging threaded rod is connected to the output end of the dragging motor provided on the motor seat by a synchronous belt, and on the dragging threaded rod, a dragging sliding seat is connected by threads which can be sliding on the dragging guide rod; on the dragging sliding seat are provided two groups of dragging material clamping cylinders, and the output of the dragging material clamping cylinders is connected rubber material pressing heads fitting the blade strip; all of the dragging motor and the material pressing cylinder are electrically connected to the power control box.

Furthermore, the transverse cutting device may include the transverse cutting bottom seat provided on the rack; on the transverse cutting bottom seat are vertically provided transverse cutting guide rods; to the upper end of the transverse cutting guide rods is provided a transverse cutting top plate; on the transverse cutting top plate is vertically provided a transverse cutting cylinder downward; the output of the transverse cutting cylinder is connected a transverse cutting and lifting seat slidably fitting the transverse cutting guide rods; at the rear side of the transverse cutting and lifting seat is provided a transverse cutting blade, and the transverse cutting blade cooperates with the lower cutting plate which is provided on the upper surface of the transverse cutting bottom seat; the transverse cutting cylinder is electrically in communication with the power control box.

The beneficial effects of the present invention are shown as follows:

The present invention may achieve automatic material feeding by the cutter blade carrying device. The dragging device may extend the upper and lower film material repeatedly to convey the blades, and the hot-pressing process may be accomplished by the film sealing device. With the present invention it is possible to automatically seal the blades and separate the product one by one with the cutting device. At last the packaging process may be accomplished with high degree of automation and greatly improve production efficiency.

With the structure of the blade transportation device, magnetic conveyer belt and sealing film strip are used as conveying platform, with its downward absorption force, it is possible to convey the blades smoothly and prevent any displacement.

The structure of the upper and lower film material feeding device may accomplish the film sealing process for both sides of the blade to protect the blade from dampness and rust.

With the structure of the blade guiding device it is possible adjust the spacing of the guiding and clamping plates by guiding air grippers to engage with blades of different sizes, and by the cooperation of the guiding pressing plate and the guiding and clamping plate it is possible to have the blades fall on the upper filming tape along the X axis direction to ensure the sealing quality of the product.

With the structure of the blade correcting device, the lifting correcting cylinder may push the correcting holding plates downward to have it fit the size of the blades, and the correcting cylinders may adjust the correcting holding plates to ensure the blades are positioned along the X axis direction furthermore to ensure sealing production of the product.

Compared with the manual feeding operation in the existing technology, the structure of the cutter blade carrying device may accomplish automatic feeding process with high efficiency, which may reduce the production cost of the blades. The structure of the defective product reclaiming device may remove the defective blades to promise the product film sealing quality.

The structure of the film sealing device may ensure easy operation and fast speed of filming process, which may improve the production efficiency.

With its sophisticated structure, the cutting assembly could separate the blade strip into several pieces in one time, which may improve the separating efficiency.

The structure of the dragging device is easy to operate and accomplish continuous feeding.

The structure of the transverse cutting device may separate the blade strip into single sealed blades, which may facilitate the package process.

REFERENCE NUMBER KEY

All various elements in the figures are shown as follows:

1. rack,
2. cutter blade carrying device,
3. lower film feeding device,
4. cutter blade transportation device,
5. defective product reclaiming device,
6. film sealing device,
7. dragging device,
8. transverse cutting device,
9. upper film feeding device,
10. blade correcting device,
11. blade guiding device,
12. blade feeding rail,
13. guide,
14. lifting correcting cylinder,
15. blade,
16. correcting holding plate,
17. correcting holding plate sliding seat,
18. correcting lifting seat,
19. correcting cylinder,
20. correcting rack,
21. correcting top plate,
22. lifting rail,
23. guiding and clamping plate,
24. guide rack,
25. adjusting screw,
26. guiding plate,
27. guiding cylinder,
28. air gripper adjusting seat,
29. guiding air gripper,
30. guiding sliding rail,
31. defective product collecting tank,
32. connecting board,
33. lifting reclaiming cylinder,
34. lifting pressing cylinder,
35. reclaiming horizontal movable sliding seat,
36. reclaiming horizontal movable cylinder,
37. material reclaiming rack,
38. reclaiming horizontal movable guiding rail,
39. guiding pressing plate,
40. pneumatic air gripper,
41. defective product detecting device,
42. film cutting cylinder,
43. film sealing top plate,
44. cutting assembly,
45. film sealing cylinder,
46. upper electric heating plate,
47. lower electric heating plate,
48. film-sealing bottom plate,
49. partition board,
50. partition supporting plate,
51. material slot,
52. blade cutting seat,
53. longitudinal cutting blade,
54. transportation supporting plate,
55. upper film guiding wheel,
56. conveyer belt,
57. lower film guiding wheel,
58. transverse cutting guide rod,
59. transverse cutting and lifting seat,
60. transverse cutting bottom seat,
61. lower cutting plate,
62. transverse cutting blade,
63. transverse cutting cylinder,
64. transverse cutting top plate,
65. coil wheel,
66. material feeding support plate,
67. guide roller,
68. dragging threaded rod,
69. dragging sliding seat,
70. dragging material clamping cylinder,
71. blade strip,
72. synchronous belt,
73. motor seat,
74. dragging motor,
75. dragging guide rod,
76. rubber material pressing head,
77. dragging base.

DETAILED DESCRIPTION OF THE ILLUSTRATED EMBODIMENT

In order to enable a person skilled in the art to better understand the technical scheme of the present invention, the following description may be given to the present invention in detail with reference to the accompanying drawings. The description of the invention is merely exemplary and explanatory and should not limit the scope of the protection scope of the present invention.

Figure 1:
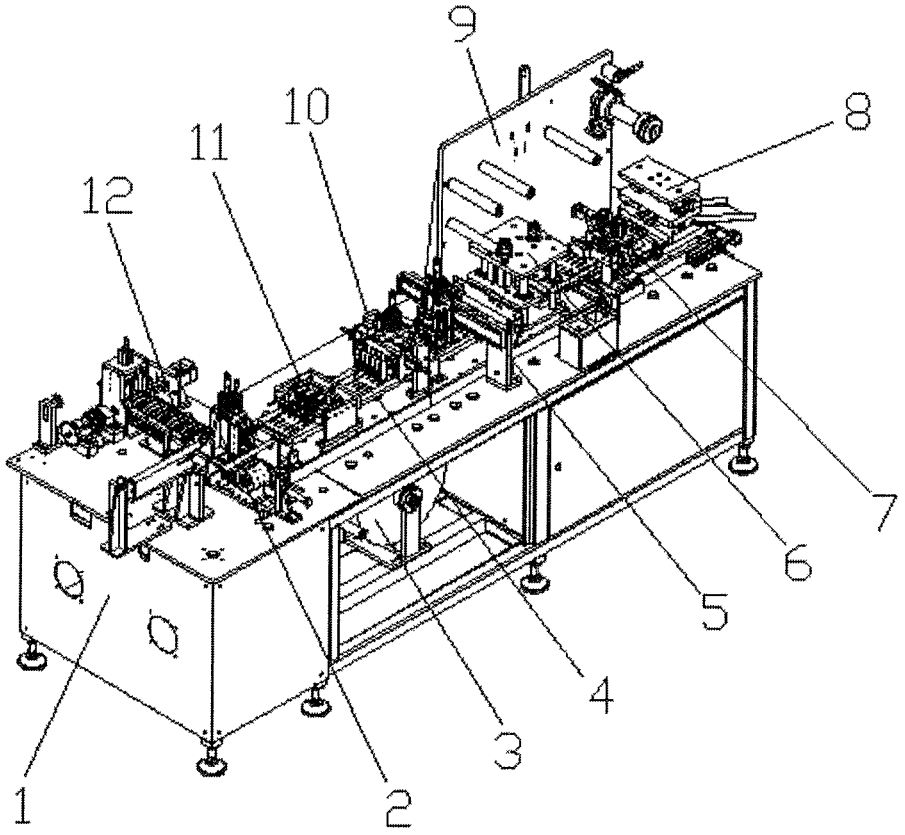
FIG. 1 shows the schematic structural diagram of the present invention.
Figure 2:
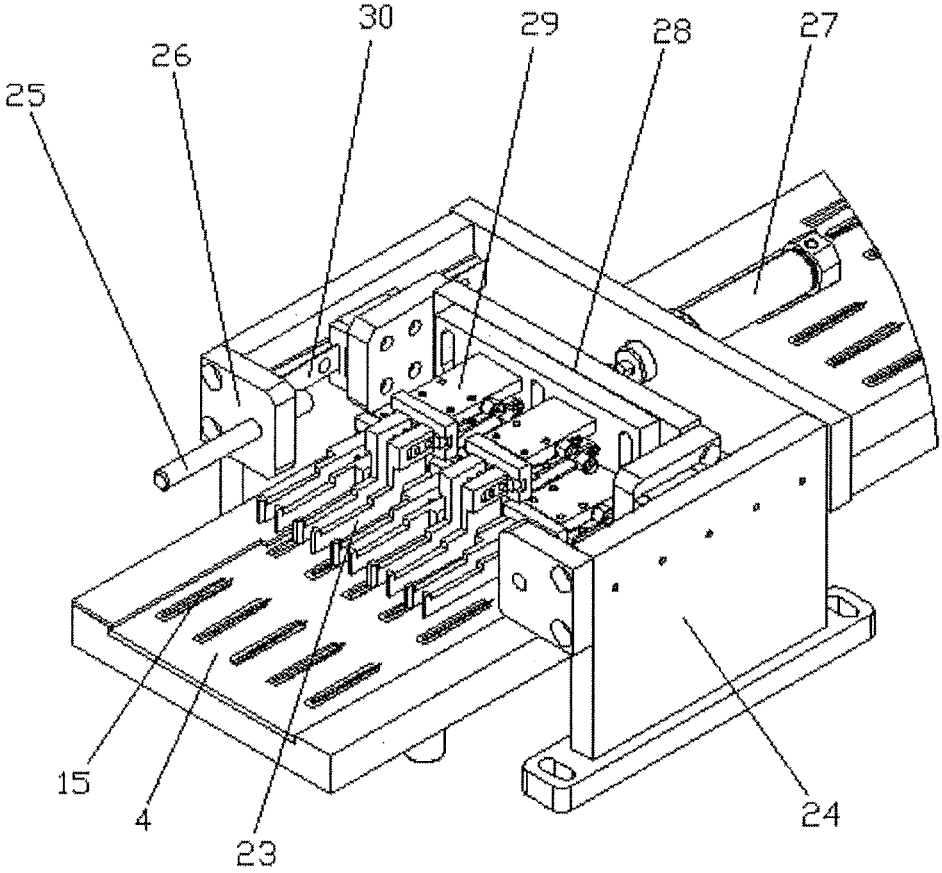
FIG. 2 shows the schematic structural diagram of the blade guiding device.
Figure 3:
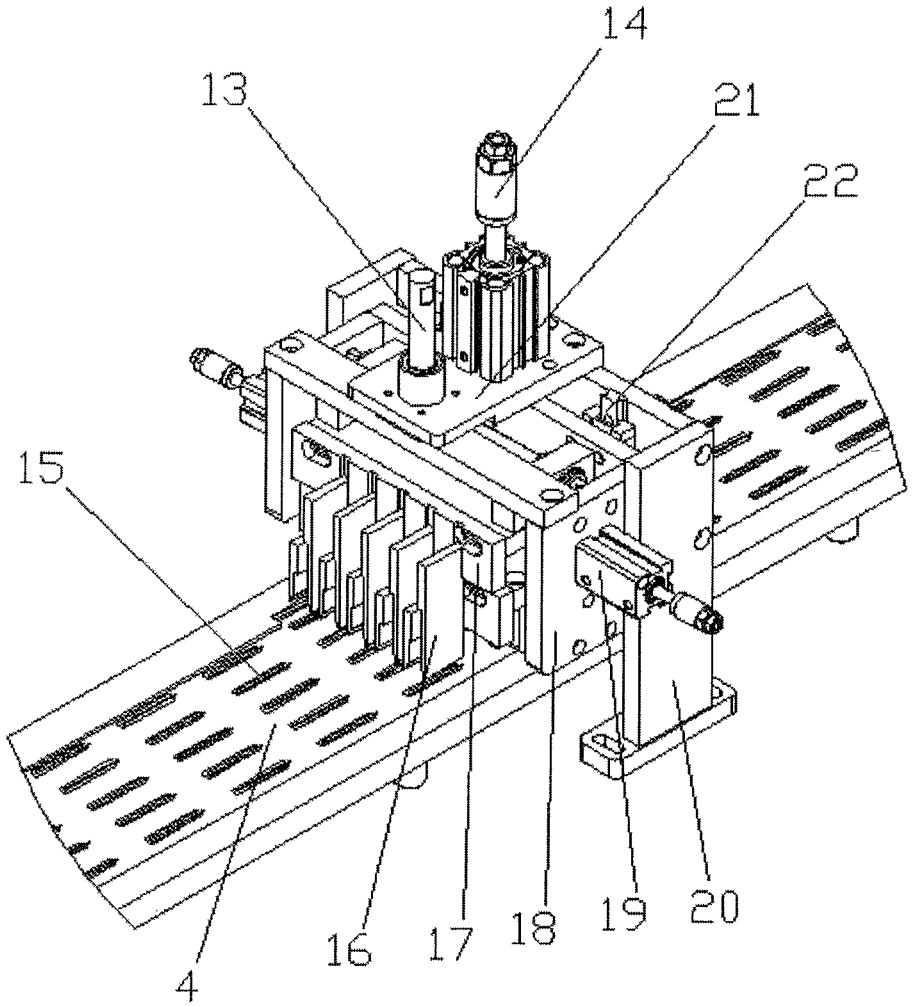
FIG. 3 shows the schematic structural diagram of the blade correcting device.
Figure 4:
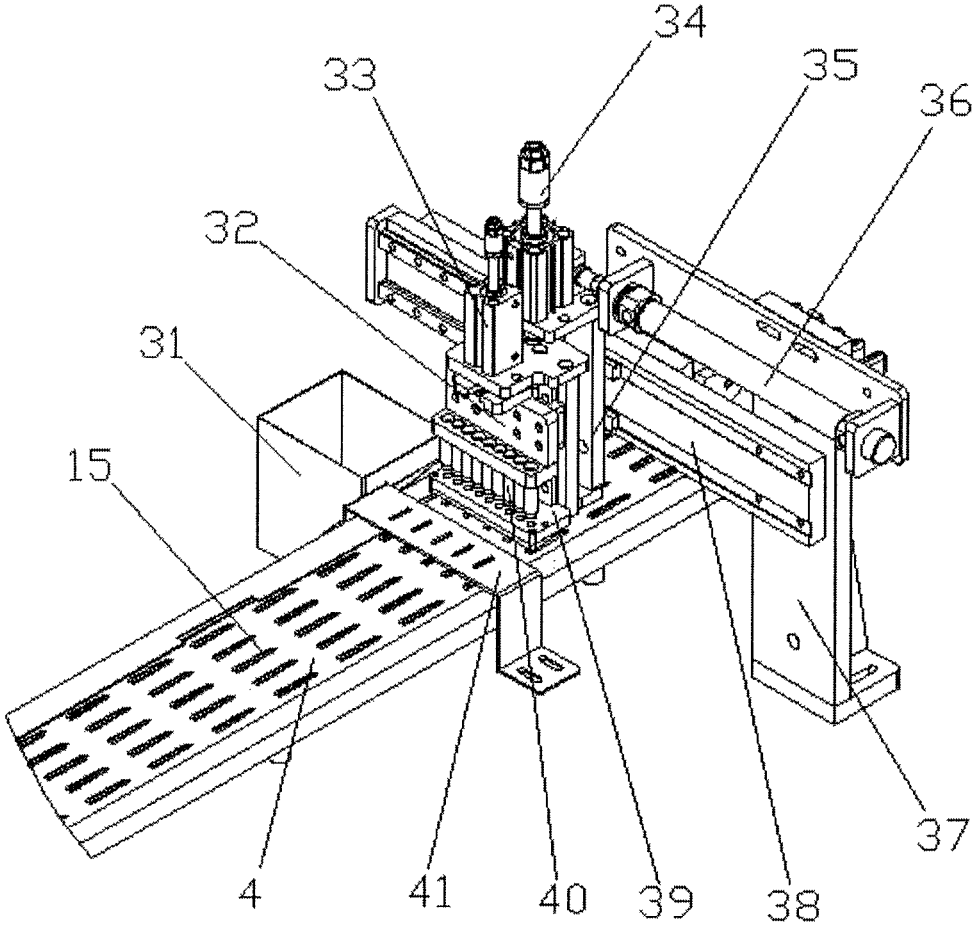
FIG. 4 shows the schematic structural diagram of the defective product reclaiming device.
Figure 5:
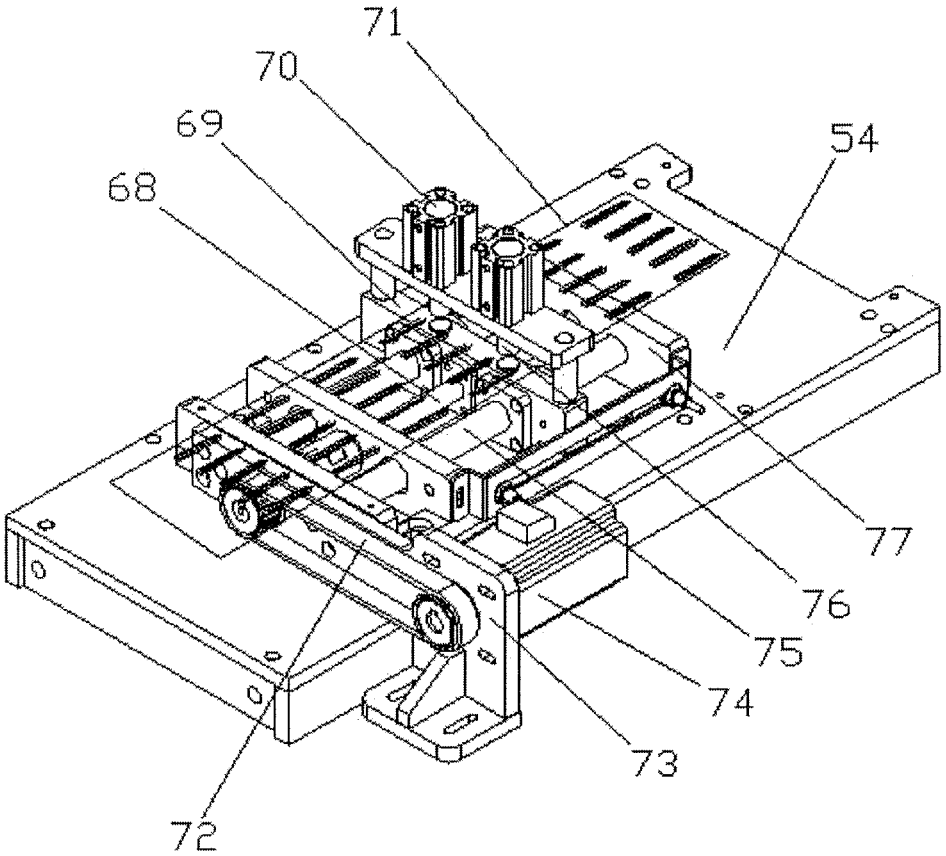
FIG. 5 shows the schematic structural diagram of the dragging device.
Figure 6:
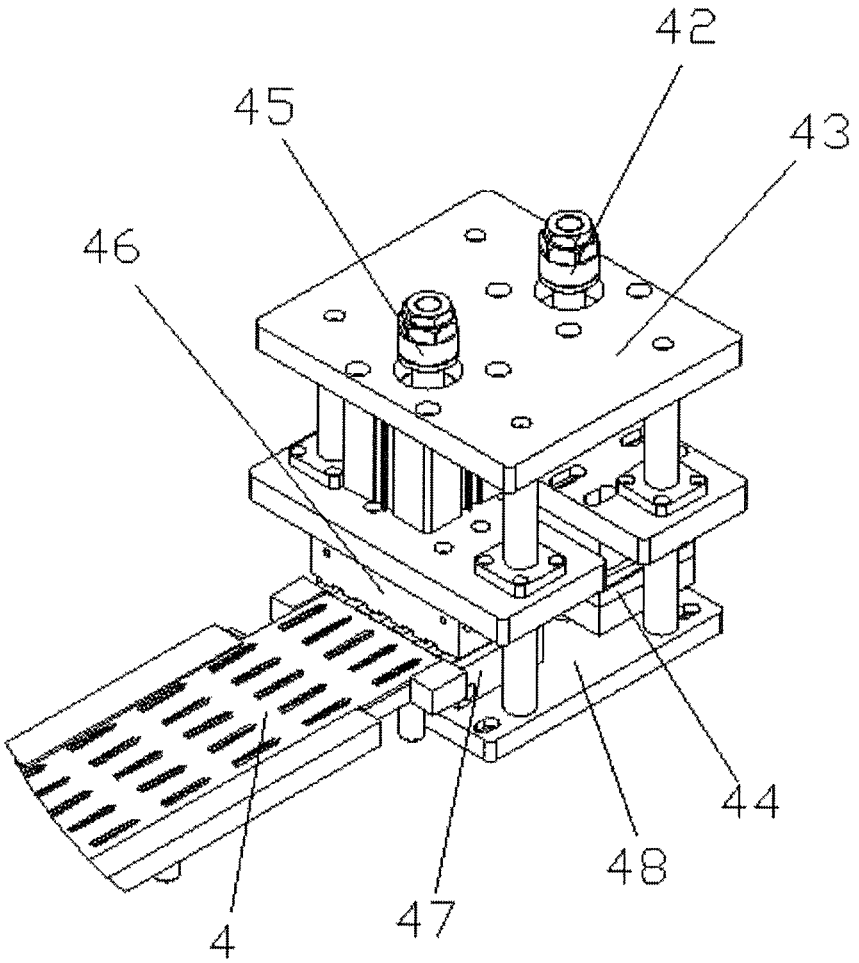
FIG. 6 shows the schematic structural diagram of the film sealing device.
Figure 7:
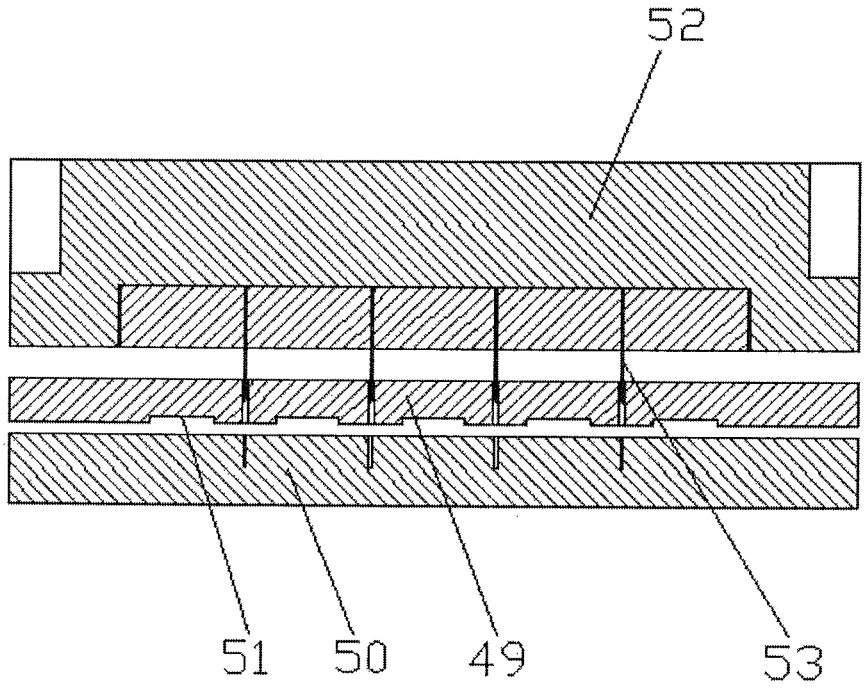
FIG. 7 shows the sectional view of the cutting assembly in FIG. 6.
Figure 8:
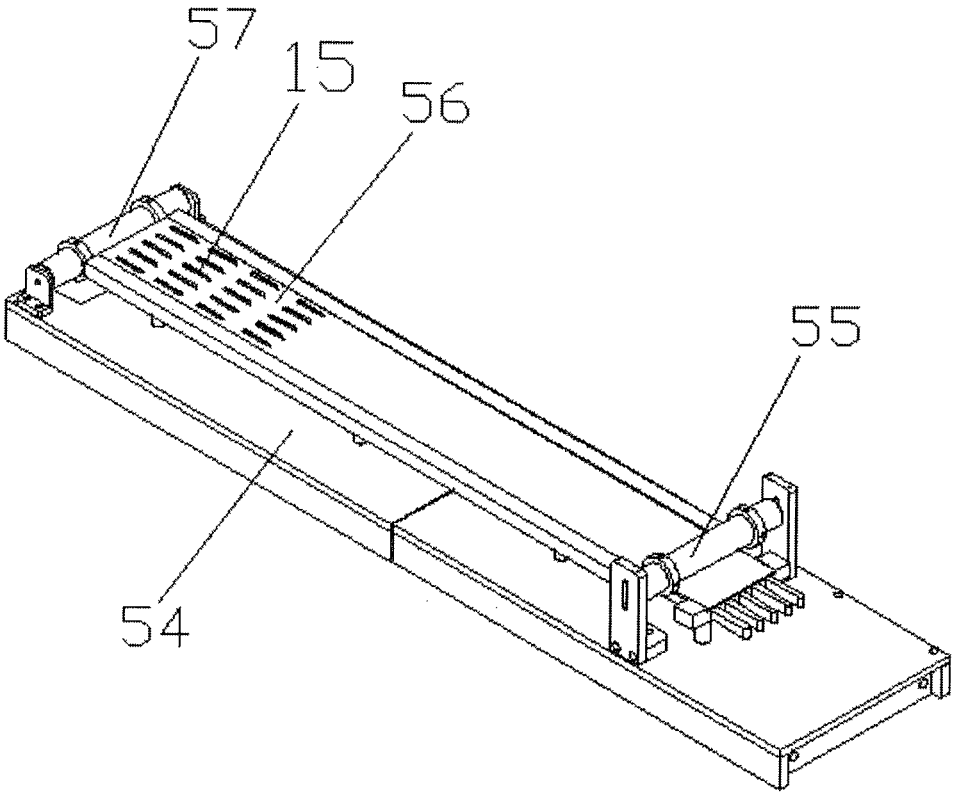
FIG. 8 shows the schematic structural diagram of the cutter blade transportation device.
Figure 9:
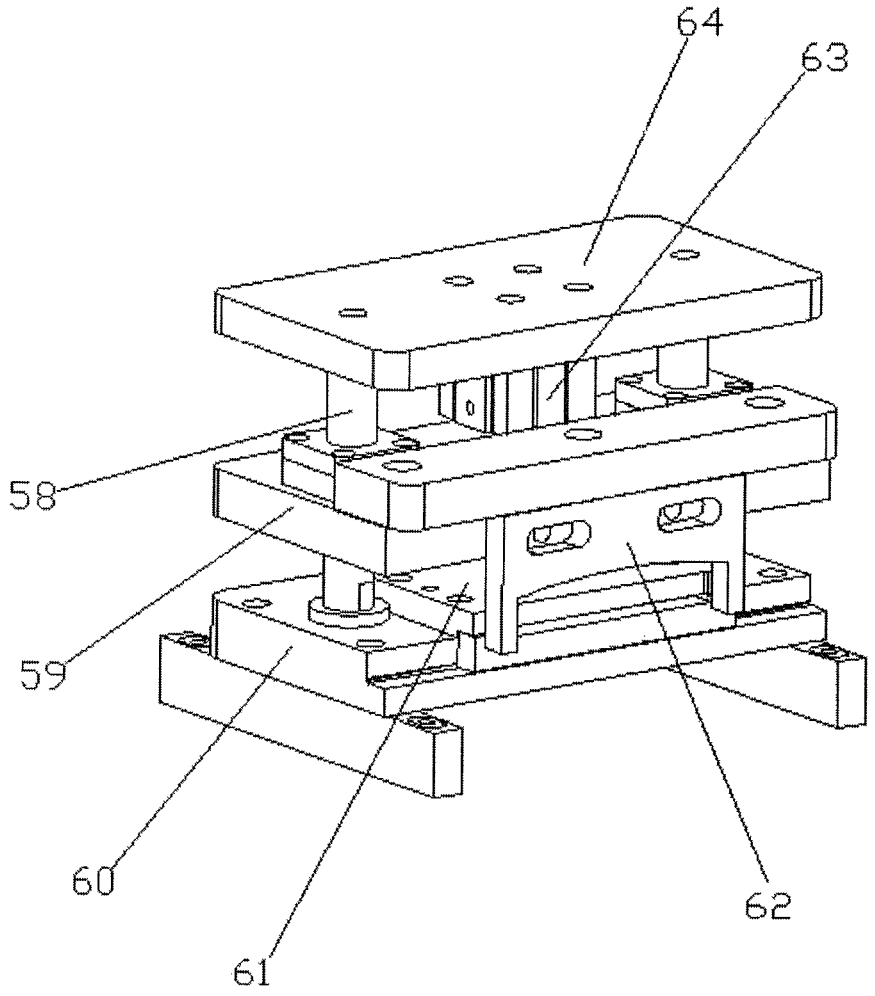
FIG. 9 shows the schematic structural diagram of transverse cutting device.
Figure 10:
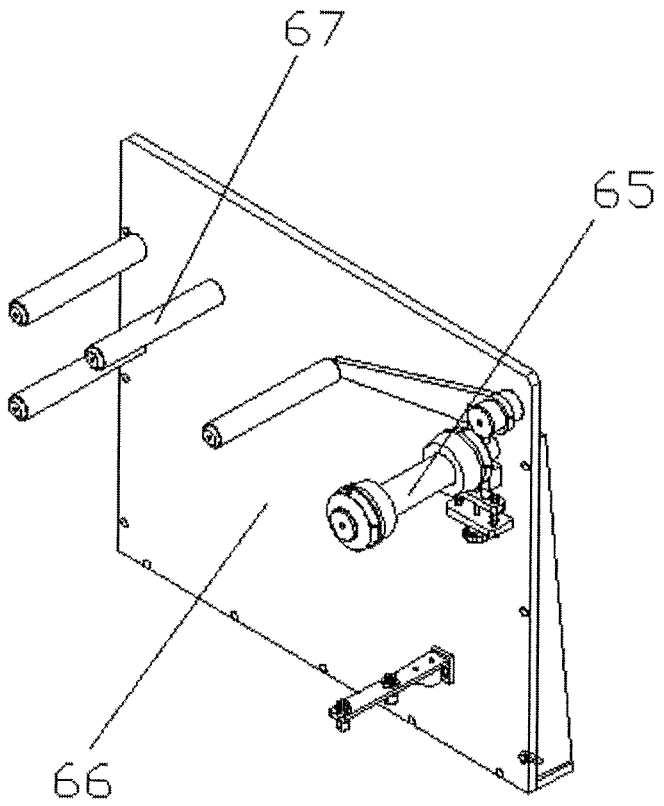
FIG. 10 shows the schematic structural diagram of the upper film feeding device.

As is shown in FIGS. 1-10, the structure of the present invention is shown as follows: a cutter blade dual side film sealing and packing assembly, includes a rack 1 and a power control box provided on the rack 1, and on the rack 1, along the X-axis extension direction, a cutter blade transportation device 4 is provided; below the cutter blade transportation device 4 and inside the rack 1 is provided a lower film feeding device 3, and in the rear side of the rack 1 is provided an upper film feeding device 9; before the cutter blade transportation device 4 and on the rack 1 are provided a blade feeding rail 12 and a cutter blade carrying device 2 cooperating with each other and after the cutter blade transportation device 4 is provided a film sealing device 6 which cooperates with the upper film feeding device 9 and lower film feeding device 3; in the rear side of the film sealing device 6 and on the rack 1 is provided a dragging device 70 fitting the blade strip 71; and at back side of the dragging device 7 is provided a transverse cutting device 8 fitting the blade strip 71; a blade guiding device 11 and a blade correcting device 10 are successively provided above the cutter blade transportation device 4 between the cutter blade carrying device 2 and the film sealing device 6; a defective product reclaiming device 5 is provided between the blade correcting device 10 and the film sealing device 6.

Preferably, the cutter blade transportation device 4 may include a transportation supporting plate 54 which is provided on the rack 1 along the X-axis direction, along the transportation direction on the transportation supporting plate 54 is provided a conveyer belt 56; to the left end of the conveyer belt 56 and on the transportation supporting plate 54 is provided an upper film guiding wheel 57 cooperating with the lower film feeding device 3 and to the right end of the conveyer belt 56 and on the transportation supporting plate 54 is provided an upper film guiding wheel 55 cooperating with the upper film feeding device 9; the conveyer belt 56 is a magnetic conveyor belt.

Preferably, both of the upper film feeding device 9 and lower film feeding device 3 may include a material feeding support plate 66 provided on the rack 1; on the material feeding support plate 66 is provided a coil wheel 65; to the front side of the coil wheel 65 and on the material feeding support plate 66 is provided a guide roller 67; the lower film strip from the lower film feeding device 3 may pass the guide roller 67, the lower film guiding wheel 57 and the conveyer belt 56 and go inside the film sealing device 6; the upper film strip of the upper film feeding device 9 may pass in turn the guide roller 67, the upper film guiding wheel 55 and go inside the film sealing device 6 working with the lower film material film tape.

Preferably, the blade guiding device 11 may include a guide rack 24 provided on the rack 1, on the guide rack 24 and along the transport direction are provided a guiding cylinder 27 and a guiding sliding rail 30; the output of the guiding cylinder 27 is connected to the air gripper adjusting seat 28 slidably cooperating with the guiding sliding rail 30; on the air gripper adjusting seat 28 and above the conveyer belt 56 are provided at least three groups of guiding air grippers 29; the front end of the guiding air gripper 29 is connected to the guiding and clamping plates 23 fitting the blades 15; the guiding cylinder 27 and the guiding air gripper 29 are electrically connected to the power control box.

Preferably, the blade correcting device 10 may include a correcting rack 20 provided on the rack 1; to the upper end of the correcting rack 20 is provided a correcting top plate 21; on the correcting top plate 21, a lifting correcting cylinder 14 is provided vertically downward, the output end of the lifting correcting cylinder 14 is connected to the correcting lifting seat 18 and the correcting lifting seat 18 slidingly cooperating with the lifting rail 22 which is provided vertically on the correcting rack 20, and to the upper end of the correcting lifting seat 18 is provided a guide rod 13 which cooperates with the correcting top plate 21 by plugging and fitting; to both the left and right sides of the correcting lifting seat 18, correcting cylinders 19 are provided symmetrically; the output ends of both correcting cylinders 19 are horizontally connected to the correcting holding plate sliding seat 17 slidably fitting with the correcting lifting seat 18; to the front side of the correcting holding plate sliding seat 17, are vertically provided the correcting clamp grips 16 cooperating with the blades 15 one by one; all of the lifting correcting cylinder 14 and the correcting cylinders 19 are electrically connected to the power control box.

Preferably, the defective product reclaiming device 5 and the cutter blade carrying device 2 may include the material reclaiming rack 37 provided on the rack 1; to the material reclaiming rack 37 are horizontally provided an reclaiming horizontal movable cylinder 36 and reclaiming horizontal movable guiding rail 38; the output end of the reclaiming horizontal movable cylinder 36 is connected to the reclaiming horizontal movable sliding seat 35 slidingly fitting the reclaiming horizontal movable guiding rail 38; on the reclaiming horizontal movable sliding seat 35 is vertically provided a lifting pressing cylinder 34; to the output end of the lifting pressing cylinder 34 is connected the material reclaiming lifting seat slidingly fitting the reclaiming horizontal movable sliding seat 35; on the material reclaiming lifting seat is vertically provided the lifting reclaiming cylinder 33 whose output is connected to the connecting board slidingly cooperating with the material reclaiming lifting seat; to the lower end of the connecting board 32 is provided a pneumatic air gripper 40 respectively fitting the blades 15; the pneumatic air grippers 40 cooperate with the guiding pressing plate 39 provided on the lower end of the connecting board 32 by plugging and fitting; to the front side of the defective product reclaiming device 5 and above the cutter blade transportation device 4 is provided a defective product detecting device 41; to the left side of the cutter blade transportation device 4 on the rack 1 is provided a defective product collecting tank 31; all of the lifting reclaiming cylinder 33, lifting pressing cylinder 34, reclaiming horizontal movable cylinder 36, pneumatic air gripper 40 and defective product detecting device 41 are electrically connected to the power control box.

Preferably, the film sealing device 6 may include a film-sealing bottom plate 48 provided on the rack 1; on the top of the film-sealing bottom plate 48 is connected to the film sealing top plate 43 by upright columns; on the film sealing top plate 43 is vertically provided a film sealing cylinder downwardly; the output end of the film sealing cylinder 45 is connected to the upper electric heating plate 46, and the upper electric heating plate 46 is in the right end of the cutter blade transportation device 4 and works in conjunction with the lower electric heating plate 47 provided on the film-sealing bottom plate 48; and on the butting side of the upper electric heating plate 46 and the lower electric heating plate 47 is provided corresponding grooves; all of the film sealing cylinder 45, the upper electric heating plate 46 and the lower electric heating plate 47 are electrically connected to the power control box.

Preferably, on the film sealing top plate 43 and at the rear side of the film sealing cylinder 45 is provided a film cutting cylinder 42 vertically downward, and the output end of the film cutting cylinder is connected to the cutting assembly 44 fitting the blade strip 71; the cutting assembly 44 may include the blade cutting seat 52 which is connected to the output of the film cutting cylinder 42; below the blade cutting seat 52 and on the film-sealing bottom plate 48 is provided a partition supporting plate 50; on the partition supporting plate 50 is provided a partition board 49 fitting the longitudinal cutting blade 53, to the bottom of the partition board 49 are provided material slots 51 fitting the blades 15, and blade slots are provided between each two groups of the material slots 51 and inside the partition board 49, the blade slot extends on the partition supporting plate 50 and fits the gap of the longitudinal cutting blade 53 provided on the bottom of the blade cutting seat 52.

Preferably, the dragging device 7 may include a dragging base 77 and a motor seat 73 which are provided on the transportation supporting plate 54; on the dragging base 77 are provided a dragging guide rod 75 and a dragging threaded rod 68 along the transportation direction; the front end of the dragging threaded rod 68 is connected to the output end of the dragging motor 74 provided on the motor seat 73 by a synchronous belt 72, and on the dragging threaded rod 68, a dragging sliding seat 69 is connected by threads which can be sliding on the dragging guide rod 75; on the dragging sliding seat 69 are provided two groups of dragging material clamping cylinders 70, and the output of the dragging material clamping cylinders 70 is connected rubber material pressing heads 76 fitting the blade strip 71; all of the dragging motor 74 and the material pressing cylinder 70 are electrically connected to the power control box.

Preferably, the transverse cutting device 8 may include the transverse cutting bottom seat 60 provided on the rack 1; on the transverse cutting bottom seat 60 are vertically provided transverse cutting guide rods 58; to the upper end of the transverse cutting guide rods 58 is provided a transverse cutting top plate 64; on the transverse cutting top plate 64 is vertically provided a transverse cutting cylinder 63 downward; the output of the transverse cutting cylinder 63 is connected a transverse cutting and lifting seat 59 slidably fitting the transverse cutting guide rods 68; at the rear side of the transverse cutting and lifting seat 59 is provided a transverse cutting blade 62, and the transverse cutting blade 62 cooperates with the lower cutting plate 61 which is provided on the upper surface of the transverse cutting bottom seat 60; the transverse cutting cylinder 63 is electrically in communication with the power control box.

During use, put the blades 15 uniformly on the blade feeding rail (12) and let the lower film material in the lower film feeding device 3 go through the lower film guiding wheel 57 and cover the surface of the magnetic conveyer belt. At the same time, the upper film strip may go through the upper film guiding wheel 55 and fits the lower film strip together. The combination of the upper and lower film strip may form the blade strip 71 which goes to the dragging device 7. With the up and down movement of the dragging material clamping cylinder 70, the rubber material pressing heads 76 may be pressing or release the blade strip 71. At the same time the dragging motor 74 may drive the dragging threaded rod 68 to rotate normally and reversely to make the dragging sliding seat 69 move back and forth reciprocally along the X axis direction to complete the blade strip 71 feeding process and the power control box may control the pneumatic air grippers 40 to collect the blades 15. Then move the blades 15 to be above the blade guiding device 11 with the reclaiming horizontal movable cylinder 36. Lower the lifting pressing cylinder 34 to have the guiding pressing plate 39 pressed against the upper end of the guiding and clamping plate 23. Press the lifting reclaiming cylinder 33 again to have the blades fall on the film strip from between the guiding and clamping plates 23. Transport the blades 15 on the upper film strip to below the blade correcting device 10 and push the correcting clamp grips 16 downward with the lifting correcting cylinder 14 to make it engage with the blades 15. Correct and adjust position of the blades 15 to ensure they are in the direction of X axis by adjusting the correcting clamp grip 16 with the correcting cylinder 19. Then transport the blades to below the defective product detecting device 41 to conduct defect detection and send the signal of the defective product detection back to the power control box. Then defective products will be taken by the defective product reclaiming device 5 to the defective product collecting tank 31. Transport the qualified products to the film sealing device 6. The upper electric heating plate 46 is pushed downwards by the film sealing cylinder 45 to have it pressed against the lower electric heating plate 47 to seal the films. The blades may be put into the bottom grooves on the upper electric heating plate 46. Sealed blade strip may go through the material slots inside the cutting assembly 44. The film cutting cylinder 42 may drive the longitudinal cutting blades 53 to accomplish cutting process and cut the blade strip 71 into strips along X axis direction. Then the blade strip 71 may be transported and pass the lower cutting plate 61. Then the transverse cutting cylinder 63 may drive the transverse cutting blade 62 to separate the blade strip 71 into single sealed blades to finish the double sides filming process.

It should be noted that the term "include" is used herein, "including" or any other variants thereof intended to encompass a non-exclusive inclusion, such that a process comprising a series of elements is included, the method, the article or the device not only comprise those elements but also include other elements not explicitly listed, or further includes the inherent elements of the process, the method, the article or the equipment.

The principle and the implementation mode of the invention are set forth in the specification. The description of the above examples is only used for helping understand the method of the invention and the core idea of the method. The above descriptions are only preferred embodiments of the present invention and it should be noted that due to the limitation of character expression, an infinite specific structure exists objectively. For persons of ordinary skill in the art, without departing from the principle of the present invention, a plurality of improvements, modifications and changes can be made. The technical features can also be combined in a proper manner. The conception and the technical scheme of the invention can be directly applied to other occasions without improving the conception and the technical scheme of the invention, which can be regarded as the protection scope of the invention.

What is claimed is:

1. A cutter blade dual side film sealing and packing assembly, comprising:

an elongated rack extending in a transportation direction;

a power control box disposed upon said rack;

a cutter blade transporter disposed upon said rack extending in said transportation direction;

a lower film feeder is disposed internally within said elongated rack and beneath said cutter blade transporter;

an upper film feeder is disposed atop said rack and downstream from said cutter blade transporter as considered in said transportation direction;

a blade feeding rail and a cutter blade carrier are disposed upstream of said cutter blade transporter and operatively cooperate with each other;

a film sealer is disposed downstream of said cutter blade transporter and operatively cooperates with said upper film feeder and said lower film feeder;

said cutter blade transporter comprises a transportation supporting plate;

a blade strip is defined within said transportation supporting plate;

a transverse cutter is disposed downstream of said upper film feeder and operatively cooperates with said blade strip;

a blade guide and a blade corrector are successively disposed above said cutter blade transporter and interposed between said cutter blade carrier and said film sealer; and a defective product reclaimer is interposed between said blade corrector and said film sealer.

2. The cutter blade dual side film sealing and packing assembly as set forth in claim 1, wherein:

a conveyer belt is mounted upon said transportation supporting plate;

a first upper film guide wheel is mounted upon said transportation supporting plate at a location immediately upstream of said conveyor belt and operatively cooperates with said lower film feeder, and a second upper film guide wheel is mounted upon said transportation supporting plate at a location adjacent to a downstream end of said conveyor belt and operatively cooperates with said upper film feeder; and said conveyer belt comprises a magnetic conveyor belt.

3. The cutter blade dual side film sealing and packing assembly of the claim 2, wherein:

both of said upper film feeder and said lower film feeder comprise a material feeding support plate which are mounted upon said rack;

a coil wheel is mounted upon each one of said material feeding support plates; and at least one guide roller is mounted upon one side of said material feeding support plate such that a lower film strip, from said lower film feeder, can be routed around said at least one guide roller (67), said first upper film guide wheel, across said conveyer belt, and into said film sealer, while an upper film strip, from said upper film feeder, can, in turn, be routed around said at least one guide roller, said second upper film guide wheel, and into said film sealer so as to operatively cooperate with the lower film strip.

4. The cutter blade dual side film sealing and packing assembly as set forth in claim 2, wherein:

said blade guide comprises a guide rack mounted upon said elongated rack;

a guide cylinder is aligned with said transportation direction and is operatively connected to an air gripper adjusting seat which is slidably mounted upon a guiding sliding rail (30);

at least three guiding air grippers are mounted upon said air gripper adjusting seat so as to be disposed above said conveyor belt;

a plurality of blades are mounted within said cutter blade transporter;

upstream ends of said at least three guiding air grippers are connected to a plurality of guiding and clamping plates which operatively cooperate with said plurality of blades; and said guiding cylinder and said at least three guiding air grippers are electrically connected to said power control box.

5. The cutter blade dual side film sealing and packing assembly as set forth in claim 1, wherein:

said blade corrector comprises a correcting rack mounted upon said elongated rack;

a correcting top plate is mounted upon an upper end portion of said correcting rack;

a vertically oriented lifting correcting cylinder is mounted upon said correcting top plate such that an output end of said lifting correcting cylinder is connected operatively connected to a correcting lifting seat which is slidably mounted upon a vertically oriented lifting rail which is mounted upon said correcting rack, an upper end portion of said correcting lifting seat comprising a vertically oriented guide rod which operatively cooperates with said correcting top plate so as to guide vertical movement of said correcting lifting seat;

one of a pair of correcting cylinders is mounted upon opposite sides of said correcting lifting seat such that output ends of each one of said pair of correcting cylinders is horizontally oriented and adapted to be connected to a correcting holding plate sliding seat which is slidably disposed within said correcting lifting seat a plurality of correcting clamp grips said plurality of blades mounted within said cutter blade transporter; and said lifting correcting cylinder and said pair of oppositely disposed correcting cylinders are electrically connected to said power control box.

6. The cutter blade dual side film sealing and packing assembly as set forth in claim 1, wherein:

said defective product reclaimer and said cutter blade carrier comprise a material reclaiming rack which is mounted upon said elongated rack;

a horizontally oriented reclaiming cylinder, and a horizontally oriented reclaiming guide rail, are mounted upon said material reclaiming rack, wherein a moveable output end of said horizontally oriented reclaiming cylinder is operatively connected to a horizontally movable reclaiming sliding seat which is slidably movable along said horizontally oriented reclaiming guide rail;

a vertically oriented lifting pressing cylinder is mounted upon said horizontally movable reclaiming sliding seat such that an output end of said lifting pressing cylinder is operatively connected to a material reclaiming lifting seat which is slidably disposed within said horizontally movable reclaiming sliding seat (35);

a vertically oriented lifting reclaiming cylinder is mounted upon said material reclaiming lifting seat such that an output end of said vertically oriented lifting reclaiming cylinder is operatively connected to a connecting board which slidably moves with respect to said material reclaiming lifting seat;

a plurality of pneumatic air grippers are mounted upon said connecting board so as to operatively engage said plurality of blades mounted within said cutter blade transporter;

a guiding pressing plate is provided upon a lower end portion of said connecting board and comprises a plurality of apertures defined therein for operatively cooperating with said plurality of pneumatic air grippers;

a defective product detector is mounted upon said defective product reclaimer so as to be disposed above said cutter blade transporter;

a defective product collecting tank is disposed on one side of said cutter blade transporter and is mounted upon said elongated rack; and said lifting reclaiming cylinder, said lifting pressing cylinder, said horizontally oriented reclaiming cylinder, said pneumatic air grippers, and said defective product detector are all electrically connected to said power control box.

7. The cutter blade dual side film sealing and packing assembly as set forth in claim 1, wherein:

said film sealer comprises a film-sealing bottom plate mounted upon said elongated rack;

a film sealing top plate is connected to said film-sealing bottom plate by a plurality of vertically oriented columns;

a vertically oriented film sealing cylinder is mounted upon said film sealing top plate such that an output end of said film sealing cylinder is operatively connected to an upper electric heating plate which is disposed above said cutter blade transporter and works in conjunction with a lower electric heating plate which is mounted upon said film-sealing bottom plate;

a plurality of corresponding grooves are defined upon an underside portion of said upper electric heating plate, and upon an upper surface portion of said lower electric heating plate; and said film sealing cylinder, said upper electric heating plate, and said lower electric heating plate are all electrically connected to said power control box.

8. The cutter blade dual side film sealing and packing assembly as set forth in claim 4, wherein:

a vertically oriented film cutting cylinder is also mounted upon said film sealing top plate such that an output end of said vertically oriented film cutting cylinder is operatively connected to a cutting assembly which is adapted to operatively cooperate with said blade strip;

said cutting assembly comprises a blade cutting seat which is operatively connected to said output end of said film cutting cylinder;

a partition supporting plate is mounted upon said film sealing bottom plate and is disposed beneath said blade cutting seat;

a partition board is interposed between said partition supporting plate and said blade cutting seat, and includes a plurality of slits for accommodating a plurality of vertically oriented cutting blades;

a plurality of material slots are defined within undersurface portions of said partition board for accommodating said plurality of blades mounted within said cutter blade transporter, wherein said plurality of slits, for accommodating a plurality of vertically oriented cutting blades, are provided within said partition board at locations between adjacent ones of said material slots and extend into said partition supporting plate.

9. The cutter blade dual side film sealing and packing assembly as set forth in claim 1, wherein:

a dragging base and a motor seat are mounted upon said transportation supporting plate (54);

a dragging guide rod and a dragging threaded rod are mounted upon said dredging base so as to extend along said transportation direction;

a dragging motor is mounted upon a motor seat and one end of said dragging threaded rod is operatively connected to an output end of said dragging motor by a synchronous belt;

a dragging sliding seat is threadedly connected to said dragging threaded rod such that as said dragging threaded rod is rotated by said dragging motor and said synchronous belt, said dragging sliding seat will move along said dragging guide rod (75);

a pair of of dragging material clamping cylinders are mounted upon said dragging slide seat where outputs of said dragging material clamping cylinders are operatively connected to rubber material pressing heads which operatively engage said blade strip;

said dragging motor and said pair of material pressing cylinders are electrically connected to said power control box.

10. The cutter blade dual side film sealing and packing assembly of the claim 1, wherein:

said transverse cutter comprises a transverse cutting bottom seat mounted upon said elongated rack;

a pair of vertically oriented transverse cutting guide rods are mounted upon said transverse cutting bottom seat;

a transverse cutting top plate is mounted upon upper ends of said transverse cutting guide rods;

a transverse cutting cylinder is mounted upon an undersurface portion of said transverse cutting top plate such that an output of said transverse cutting cylinder is connected to a transverse cutting and lifting seat which is slidably movable in the vertical direction along said vertically oriented transverse cutting guide rods;

a transverse cutting blade is mounted upon said transverse cutting and lifting seat such that said transverse cutting blade operatively cooperates with a lower cutting plate which is mounted upon an upper surface portion of said transverse cutting bottom seat; and said transverse cutting cylinder is electrically connected to said power control box.

* * * * *